US007952543B2

(12) United States Patent
Chang et al.

(10) Patent No.: US 7,952,543 B2
(45) Date of Patent: May 31, 2011

(54) DRIVE CIRCUIT, DISPLAY APPARATUS, AND METHOD FOR ADJUSTING SCREEN REFRESH RATE

(75) Inventors: Meng-Hsiang Chang, Hsinchu (TW); Chi-Wen Chen, Hsinchu (TW)

(73) Assignee: Au Optronics Corp., Hsinchu (TW)

( * ) Notice: Subject to any disclaimer, the term of this patent is extended or adjusted under 35 U.S.C. 154(b) by 848 days.

(21) Appl. No.: 11/926,507

(22) Filed: Oct. 29, 2007

(65) Prior Publication Data

US 2008/0225062 A1 Sep. 18, 2008

(30) Foreign Application Priority Data

Mar. 12, 2007 (TW) ..... 96108372 A

(51) Int. Cl.
*G09G 3/30* (2006.01)

(52) U.S. Cl. ..... 345/76

(58) Field of Classification Search ..... 345/691
See application file for complete search history.

(56) References Cited

U.S. PATENT DOCUMENTS

| | | | | |
|---|---|---|---|---|
| 6,836,293 | B2 * | 12/2004 | Itoh et al. | 348/452 |
| 2003/0010894 | A1 * | 1/2003 | Yoshihara et al. | 250/208.1 |
| 2004/0199798 | A1 * | 10/2004 | Whelan et al. | 713/300 |
| 2005/0068254 | A1 * | 3/2005 | Booth | 345/3.3 |
| 2005/0162566 | A1 * | 7/2005 | Chuang et al. | 348/714 |
| 2006/0066601 | A1 * | 3/2006 | Kothari et al. | 345/204 |
| 2006/0072664 | A1 * | 4/2006 | Kwon et al. | 375/240.16 |
| 2006/0259804 | A1 * | 11/2006 | Fry | 713/324 |
| 2006/0267972 | A1 * | 11/2006 | Yi | 345/211 |
| 2007/0008250 | A1 * | 1/2007 | Hoppenbrouwers et al. | 345/76 |
| 2007/0279407 | A1 * | 12/2007 | Vasquez et al. | 345/213 |
| 2008/0001934 | A1 * | 1/2008 | Wyatt | 345/204 |
| 2008/0079739 | A1 * | 4/2008 | Gupta et al. | 345/520 |

FOREIGN PATENT DOCUMENTS

| | | | |
|---|---|---|---|
| GB | 2381931 A | * | 5/2003 |
| JP | 2001042282 | | 2/2001 |
| TW | 594142 | | 6/2004 |

OTHER PUBLICATIONS

English language translation of abstract of JP 2001042282.
Taiwan Office Action dated Jul. 13, 2010.
English translation of Taiwan Office Action and pertinent parts of TW 594142.

* cited by examiner

*Primary Examiner* — Richard Hjerpe
*Assistant Examiner* — Dorothy Harris
(74) *Attorney, Agent, or Firm* — Thomas, Kayden, Horstemeyer & Risley, LLP

(57) ABSTRACT

A display apparatus and a drive circuit for adjusting a screen refresh rate of the display apparatus and a method thereof are disclosed. The display apparatus comprises an OLED diode display array and a drive circuit. The drive circuit comprises a detection unit, a clock generating unit, and a timing control unit. The detection unit determines whether a plurality of frames displayed by the OLED diode display array are configured as a dynamic frame. The detection unit generates a first control signal when the displayed frames are not configured as a dynamic frame, and the detection unit generates a second control signal when the displayed frames are configured as a dynamic frame. The clock generating unit generates a clock signal, the frequency of which is a first frequency in response to the first signal, or a second frequency in response to the second signal. The first frequency is greater than the second frequency. The timing control unit sets the screen refresh rate of the display apparatus in response to the frequency of the clock signal.

25 Claims, 5 Drawing Sheets

DRIVE CIRCUIT, DISPLAY APPARATUS, AND METHOD FOR ADJUSTING SCREEN REFRESH RATE

This application claims the benefit of priority based on Taiwan Patent Application No. 096108372 filed on Mar. 12, 2007, the disclosures of which are incorporated herein by reference in their entirety.

CROSS-REFERENCES TO RELATED APPLICATIONS

Not applicable.

BACKGROUND OF THE INVENTION

1. Field of the Invention

The present invention relates to a display apparatus, a drive circuit and a method for adjusting a screen refresh rate of the display apparatus.

2. Descriptions of the Related Art

In recent years, developments for flat panel displays have grown rapidly, gradually replacing traditional cathode radiation tube (CRT) displays. Nowadays, major flat panel displays include: Organic Light-Emitting Diodes Displays (OLEDs), Plasma Display Panel (PDP), Liquid Crystal Displays (LCDs), and Field Emission Displays (FEDs).

Although active type OLED displays exhibit a faster response speed than LCDs during a frame transition process, image ghosting still occurs in OLEDs just as in LCDs. As shown in FIG. 1 and FIG. 2, FIG. 1 illustrates a screenshot of the display frame in the standby state of a mobile phone utilizing an active type OLED display, and FIG. 2 illustrates a screenshot of the frame of the mobile phone during the transition from the standby state to the dialing state. During the frame transition (i.e., from the frame shown in FIG. 1 to that shown in FIG. 2), the frame of the standby state may remain in the frame of the dialing state shown in FIG. 2, thus causing the phenomenon of image ghosting to occur (e.g., 13:45:20 shown in FIG. 2). This is especially significant in case of static frames.

To solve the image ghosting problem during a frame transition, the display apparatus of Taiwan Patent No. I226949 alternatively displays a black frame and various data frames via a doubled display rate in an attempt to eliminate the image ghosting. However, this method to increase the screen refresh rate requires a corresponding increase of the clock rate generated by a drive circuit in the display apparatus, which in turn increases the power consumption, resulting in a low power efficiency and reduced service life of the display apparatus. As a result, the need to conserve energy and prolong the service life of the display apparatus while mitigating the problem of image ghosting still exists in the display manufacturing field.

SUMMARY OF THE INVENTION

An objective of this invention is to provide a drive circuit that adjusts the screen refresh rate of a display device. The drive circuit comprises a detection unit, a clock generating unit, and a timing control unit. The detection unit determines whether a plurality of displayed frames is configured as a dynamic frame. The detection unit generates a first control signal when the displayed frames are not configured as a dynamic frame. Otherwise, the detection unit generates a second control signal. The clock generating unit generates a clock signal, the frequency of which is a first frequency in response to the first signal, or a second frequency in response to the second signal. And, the first frequency is greater than the second frequency. The timing control unit sets the screen refresh rate in response to the frequency of the clock signal.

Another objective of this invention is to provide a display apparatus, which comprises an OLED display array and a drive circuit. The OLED display array displays a plurality of frames according to the screen refresh rate. The drive circuit determines whether the displayed frames are configured as a dynamic frame. The frequency of the clock signal is set to a first frequency when the displayed frames are not configured as a dynamic frame. Otherwise, the frequency of the clock signal is set to a second frequency. And, the first frequency is greater than the second frequency. The drive circuit sets the screen refresh rate in response to the resulting frequency of the clock signal.

Yet a further objective of this invention is to provide a method for adjusting the screen refresh rate. The method comprises the steps of: determining whether a plurality of displayed frames are configured as a dynamic frame; generating a first control signal when the displayed frames are not configured as a dynamic frame; generating a second control signal when the displayed frames are configured as a dynamic frame; generating a clock signal, wherein the frequency of the clock signal is a first frequency in response to the first signal, or a second frequency in response to the second signal; and setting the screen refresh rate in response to the resulting frequency of the clock signal. The first frequency is greater than the second frequency.

This invention utilizes an ordinary screen refresh rate, such as 60 Hz for dynamic frames, and a higher screen refresh rate, such as 120 Hz for non-dynamic frames. Therefore, a display apparatus can utilize these various screen refresh rates to mitigate the problem of frame ghosting, while achieving reduced power consumption and prolonged service life.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
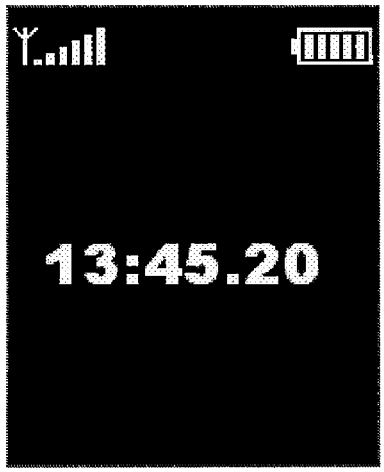
FIG. 1 (Prior Art)
FIG. 1 is a screenshot of the display frame illustrating the standby state of a mobile phone utilizing an active type OLED display apparatus.
Figure 2:
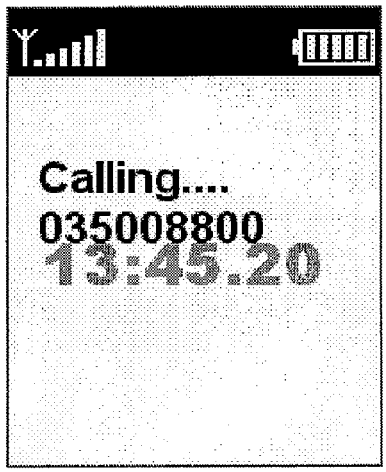
FIG. 2 (Prior Art)
FIG. 2 is a screenshot of the display frame of the mobile phone utilizing an active type OLED display apparatus during a transition to a dialing frame.
Figure 3:
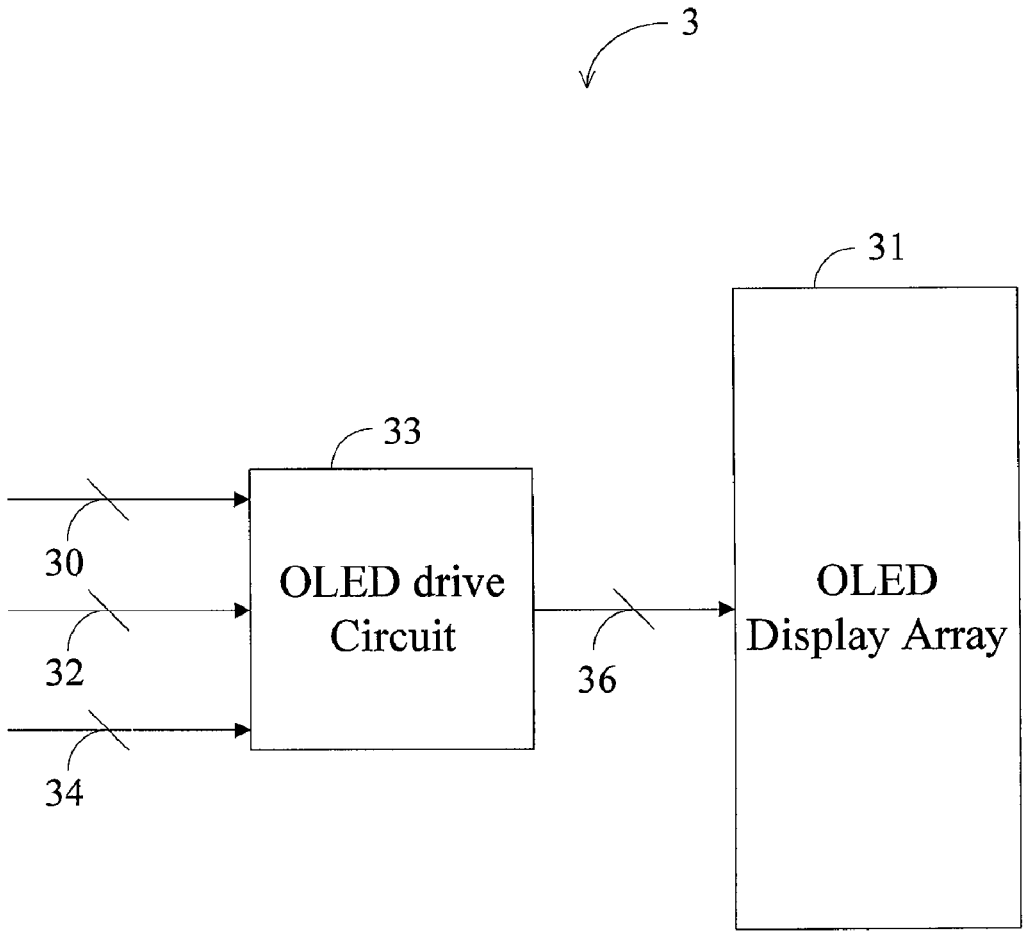
FIG. 3 is a diagram illustrating a first embodiment of this invention.

As shown in FIG. 3, a first embodiment of the present invention is an OLED display apparatus 3. The OLED display apparatus 3 comprises an OLED display array 31 and an OLED drive circuit 33. The OLED drive circuit 33 is configured to receive frame data 30, a mode signal 32, and a pixel setting signal 34. The frame data 30 comprises a plurality of neighbor frames, and the OLED drive circuit 33 determines whether the neighbor frames are configured as a dynamic frame. A dynamic frame means that greater than or equal to 50 percent of respective pixel data vary continuously in greater than or equal to 50 percent of neighbor frames. For example, presuming that the frame data 30 comprises ten neighbor frames, and more than half of respective pixel data vary in at least five of the previous ten neighbor frames, then the ten neighbor frames are defined as a dynamic frame. Otherwise, they are defined as a static frame. Additionally, whether a frame is dynamic or static can also be determined by the mode signal 32. More specifically, when the display mode is in a dynamic display mode, that is, when greater than or equal to a first predetermined percentage (e.g. 50 percent) of respective pixel data vary continuously in greater than or equal to a second predetermined percentage (e.g. 50 percent) of neighbor frames, the frame data 30 is defined as a dynamic frame. On the contrary, if the display mode is not a dynamic display mode, then the frame data 30 is defined as a static frame. The first and the second predetermined percentage can be set by those of ordinary skill in this field, according to actual operations and requirements. The display mode determined by the mode signal 32 can be changed in response to an order inputted by a user. For example, when the user inputs an order to play an animation, the mode signal 32 will direct the apparatus into a dynamic display mode. The pixel setting signal 34 is used to set a pixel. It should be noted that the definition of a dynamic frame depends on the actual operations. For example, the percentages described above can be adjusted to be higher or lower than 50%, and the present invention is not limited to this value.

When the frames are determined as a static frame, the OLED drive circuit 33 sets a frequency of a clock signal to a first frequency; otherwise, when the frames are determined as dynamic, the frequency of the clock signal is set to a second frequency. This clock signal dictates a screen refresh rate, that is, the frequency for displaying these frames. Once the frequency of the clock signal is set based on the frame state by the OLED drive circuit 33, these frames are displayed by the OLED display array 31 according to the pixel data 36.

The second frequency is an original display frequency of these neighbor frames. When the OLED drive circuit 33 sets the screen refresh rate in response to the first frequency, these neighbor frames are displayed alternately with black frames. As a result, the first frequency is greater than or equal to twice the second frequency. However, this invention is not limited to such an amount that the first frequency exceeds the second frequency. For example, if the second frequency is set to 60 Hz, the first frequency can be set to 120 Hz.

Figure 4:
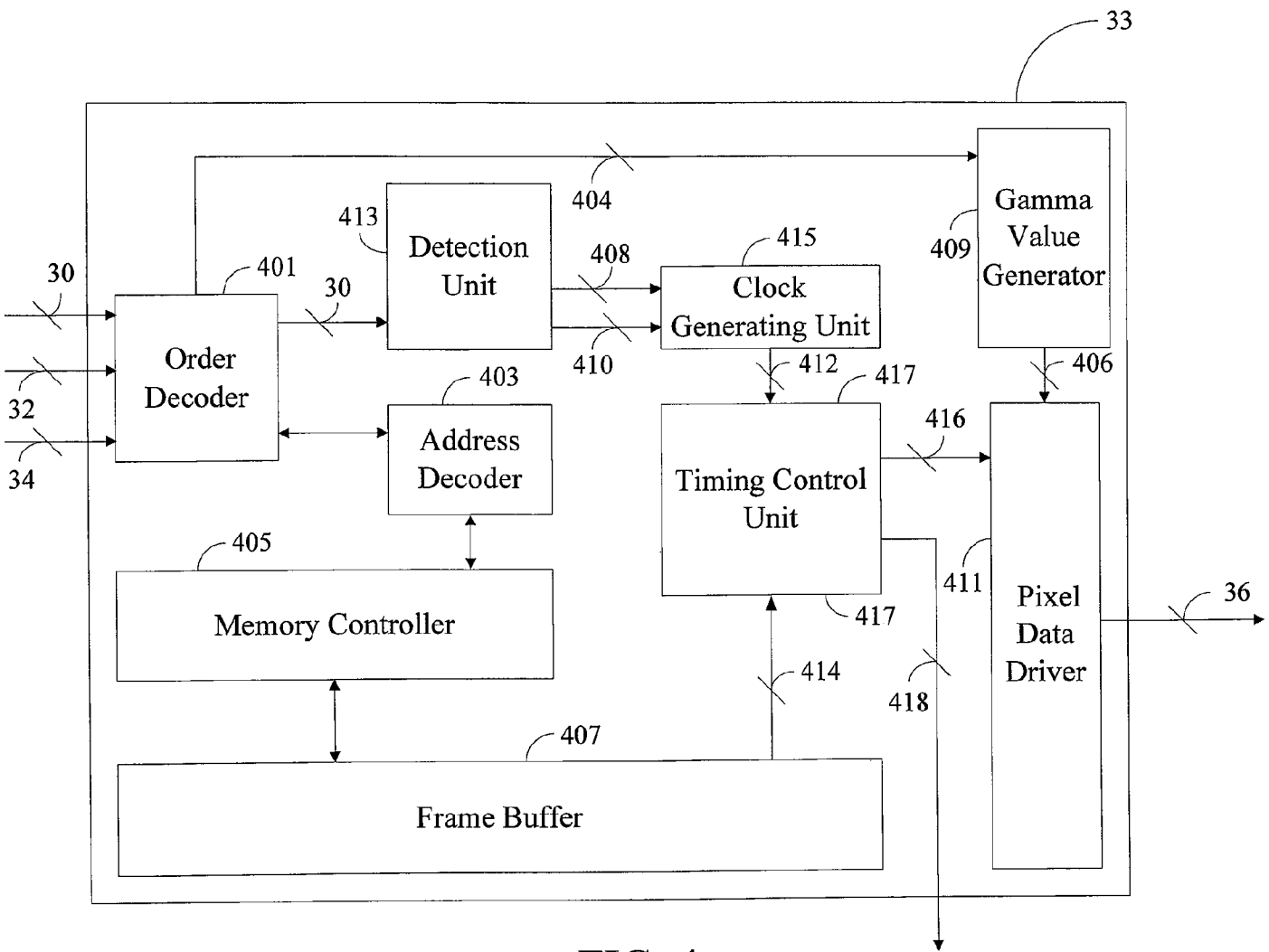
FIG. 4 is a block diagram illustrating a drive circuit of the first embodiment of this invention.

A detailed structure of the OLED drive circuit 33 is shown in FIG. 4. The OLED drive circuit 33 comprises an order decoder 401, an address decoder 403, a memory controller 405, a frame buffer 407, a gamma value generator 409, a pixel data driver 411, a detection unit 413, a clock generating unit 415, and a timing control unit 417. The order decoder 401 is configured to receive the frame data 30, the mode signal 32, and the pixel setting signal 34, thereby to control the display mode and set the timing. The frame data 30 is processed by the address decoder 403 and the memory controller 405, and is then stored in the frame buffer 407 for access by the timing control unit 417. The gamma value generator 409 is configured to receive a signal 404 from the order decoder 401 to generate a gamma signal 406. The detection unit 413 is configured to receive the frame data 30 and the mode signal 32 via the order decoder 401, and determine whether the frames to be displayed in the OLED display 3 (FIG. 3) are configured as a dynamic or a static frame (or a dynamic or a static display mode) according to the frame data 30 and/or the mode signal 32 respectively. In other words, the detection unit 413 detects whether the neighbor frames in the frame data 30 are configured as a dynamic or a static frame, or finds out the display mode through the mode signal 32, thereby to define the frame data 30 as a dynamic frame (dynamic display mode) or a static frame (static display mode). In the case of a static frame (static display mode), the detection unit 413 generates a first control signal 408. Otherwise, in case of a dynamic frame (dynamic display mode), the detection unit 413 generates a second control signal 410. The clock generating unit 415 is configured to generate a clock signal 412 with an associated first frequency when the clock generating unit 415 receives the first control signal 408 and a second frequency when the clock generating unit 415 receives the second control signal 410. The timing control unit 417 receives buffered frame data 414, and sets the screen refresh rate for the buffered frame data 414 in response to the frequency of the clock signal 412 to generate a frame signal 416 and a switching signal 418 for controlling the switching of horizontal scan lines in the display array 31 (FIG. 3). The pixel data driver 411 receives the gamma signal 406 and the frame signal 416, and combines them into pixel data 36 for outputting to the OLED display array 31. The pixel data 36 additionally comprises the frames and the information about display clocks.

It should be noted that, although two signal lines shown in FIG. 4 transmit the first control signal 408 and the second control signal 410 separately, this invention is not limited to transmission of these two signals via separate lines. More particularly, the detection unit 413 can be designed to indicate a dynamic frame (dynamic display mode) and a static frame (static display mode) respectively with a "high level" and a "low level" of a signal. In other words, the first control signal 408 can be represented by the high level of the signal, while the second control signal 410 be represented by the low level of the same signal, thus to indicate the dynamic frame (dynamic display mode) and the static frame (static display mode) via a single signal line.

Figure 5:
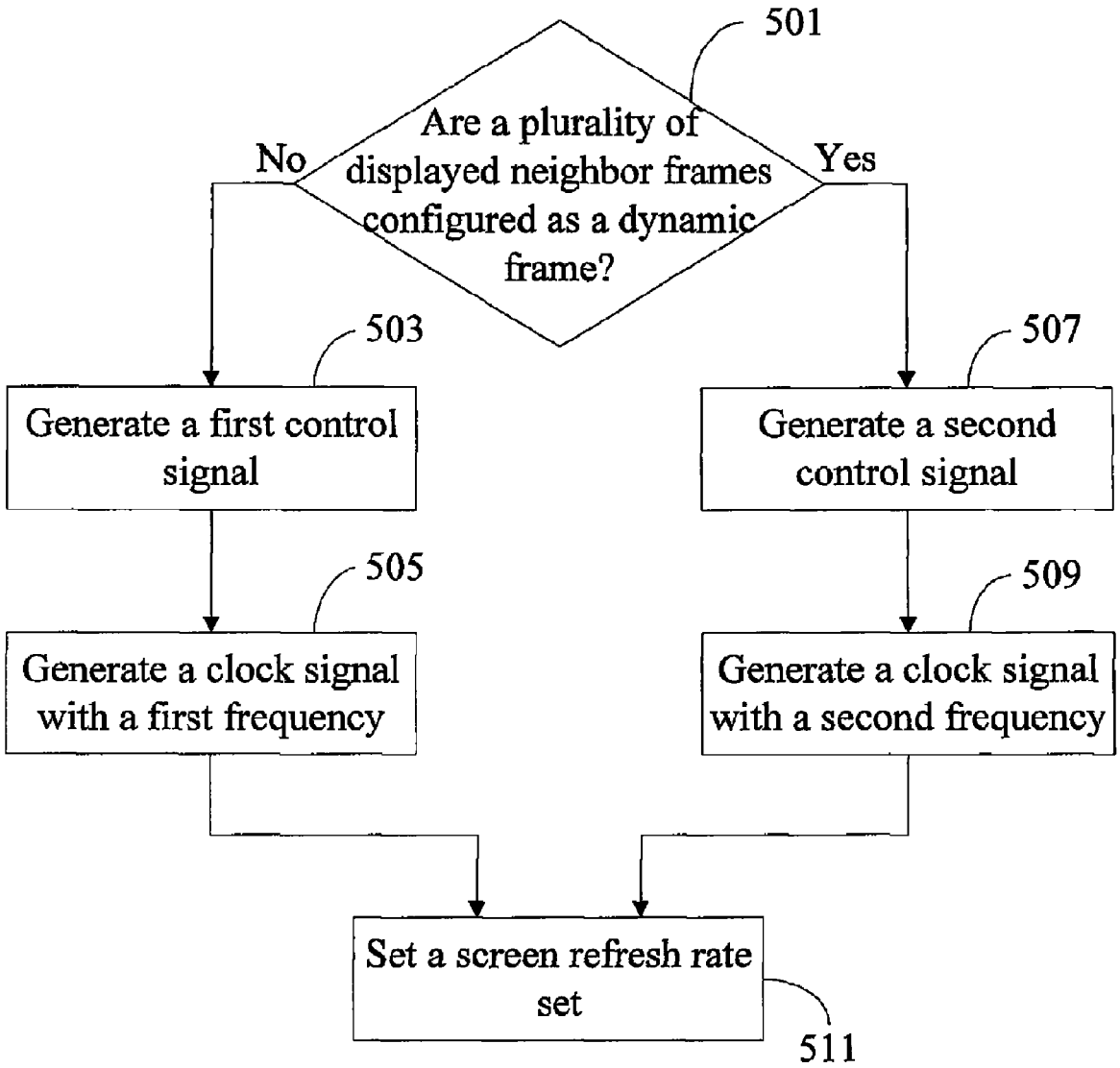
FIG. 5 is a flow chart illustrating a second embodiment of this invention.

A second embodiment of this invention is a method for adjusting a screen refresh rate in the OLED display apparatus 3 of the first embodiment. As shown in FIG. 5, the method comprises the following steps. In step 501, it is determined whether a plurality of displayed neighbor frames are configured as a dynamic frame. If not, the method proceeds to step 503 to generate a first control signal, and in response to this, a clock signal with a first frequency is generated in step 505. Otherwise, if the displayed neighbor frames are configured as a dynamic frame, then the method proceeds to step 507 to generate a second control signal, and in response to this, a clock signal of a second frequency is generated in step 509. Subsequent to step 505 or 509, the screen refresh rate is set in step 511 in response to the frequency of the clock signal, and the displayed neighbor frames will be displayed with this screen refresh rate.

Figure 6A:
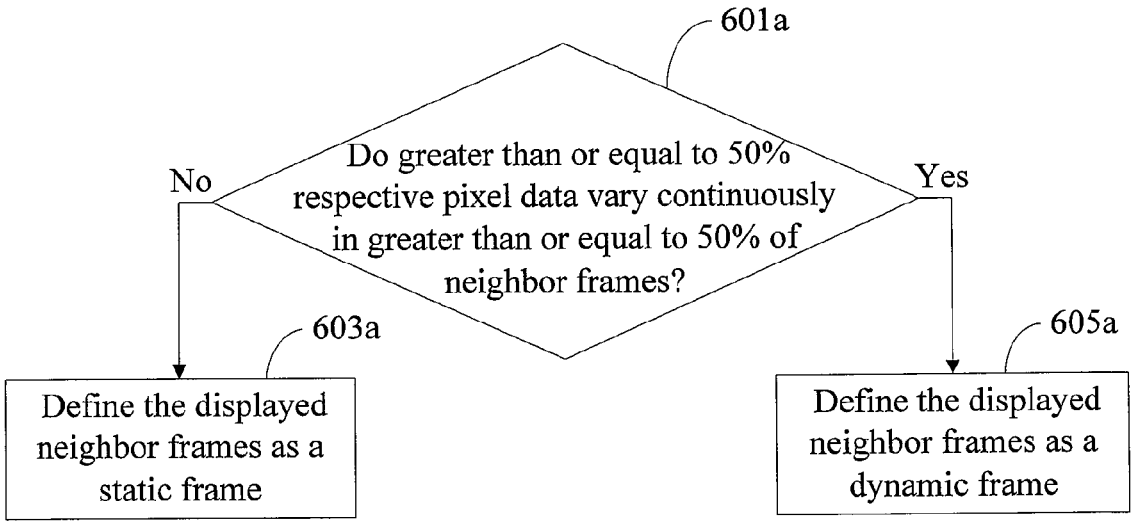
FIG. 6A is another flow chart of the second embodiment of this invention.

In the second embodiment, step 501 can be performed through two ways, the first of which is shown in FIG. 6A and comprises the following steps. First in step 601*a*, it is determined whether greater than or equal to a first predetermined percentage (e.g. 50 percent) of respective pixel data vary continuously in greater than or equal to a second predetermined percentage (e.g. 50 percent) of neighbor frames. If not, then the displayed neighbor frames are defined as a static frame in step 603*a*. Otherwise, the displayed neighbor frames are defined as a dynamic frame in step 605*a*. It should be notes that the definition of a dynamic frame depends on the actual operations; for example, the percentages described above can be adjusted to be higher or lower than 50%, and this invention is not limited to this value. The first and the second predetermined percentage can be set by those with moderate skill in this field according to actual operations and requirements.

Figure 6B:
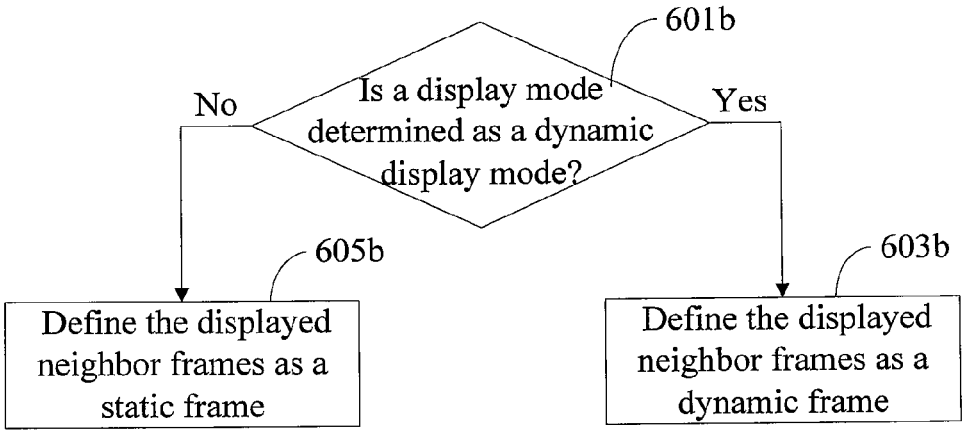
FIG. 6B is yet another flow chart of the second embodiment of this invention.

The second way to perform step 501 is shown in FIG. 6B and comprises the following steps. First in step 601*b*, it is determined whether the display mode is a dynamic display mode. If so, then the displayed neighbor frame is defined as a dynamic frame in step 603*b*. Otherwise, the displayed neighbor frame is defined as a static frame in step 605*b*.

In addition to the steps depicted in FIGS. 5, 6A and 6B, the second embodiment can also execute all the operations of the first embodiment. Those skilled in the art can understand the corresponding steps and operations of the second embodiment by following the descriptions of the first embodiment, and thus no unnecessary detail is given.

Accordingly, the present invention utilizes the original screen refresh rate for dynamic frames, and a higher screen refresh rate for non-dynamic frames. Therefore, a display apparatus can utilize these various screen refresh rates to mitigate the problem of frame ghosting, while achieving reduced power consumption and prolonged service life.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A drive circuit for adjusting a screen refresh rate, comprising:

a detection unit for determining whether a plurality of displayed frames of an organic light emitting diode display apparatus are configured as a dynamic frame, in which the detection unit generates a first control signal when the displayed frames are not configured as a dynamic frame, and the detection unit generates a second control signal when the displayed frames are configured as a dynamic frame;

a clock generating unit for generating a clock signal, wherein a frequency of the clock signal is a first frequency in response to the first control signal, and the frequency of the clock signal is a second frequency in response to the second control signal, the first frequency is greater than the second frequency; and a timing control unit for setting the screen refresh rate in response to the frequency of the clock signal.

2. The drive circuit as claimed in claim 1, wherein the detection unit determines whether pixel data being greater than or equal to a second predetermined percentage in a plurality of neighbor frames being greater than or equal to a first predetermined percentage vary continuously, in which the neighbor frames are defined as a static frame and the detection unit generates the first control signal when the pixel data in the neighbor frames do not vary continuously, and the neighbor frames are defined as the dynamic frame when the pixel data in the neighbor frames vary continuously.

3. The drive circuit as claimed in claim 2, wherein the first predetermined percentage is 50%.

4. The drive circuit as claimed in claim 2, wherein the second predetermined percentage is 50%.

5. The drive circuit as claimed in claim 2, wherein the neighbor frames and a black frame are displayed alternately when the frequency of the clock signal is the first frequency.

6. The drive circuit as claimed in claim 2, wherein the second frequency is an original display frequency of the neighbor frames.

7. The drive circuit as claimed in claim 1, wherein the detection unit detects a display mode of the drive circuit, the detection unit generates the second control signal when the display mode is a dynamic display mode, and the detection unit generates the first control signal when the display mode is not the dynamic display mode, the dynamic display mode means that pixel data being greater than or equal to a second predetermined percentage in a plurality of neighbor frames being greater than or equal to a first predetermined percentage vary continuously.

8. The drive circuit as claimed in claim 7, wherein the detection unit determines the display mode in response to an order inputted by a user.

9. The drive circuit as claimed in claim 1, wherein the first frequency is greater than or equal to twice the second frequency.

10. An organic light emitting diode (OLED) display apparatus, comprising:

an organic light-emitting diode display array for displaying a plurality of frames according to a screen refresh rate; and a drive circuit for determining whether the displayed frames of the OLED display apparatus are configured as a dynamic frame, in which the drive circuit sets a frequency of a clock signal into a first frequency when the displayed frames are not configured as a dynamic frame, and the drive circuit sets the frequency of the clock signal into a second frequency when the displayed frames are configured as a dynamic frame, wherein the first frequency is greater than the second frequency;

wherein the drive circuit sets the screen refresh rate in response to the frequency of the clock signal.

11. The OLED display apparatus as claimed in claim 10, the drive circuit further comprising:

a detection unit for determining whether the displayed frames are configured as a dynamic frame, in which the detection unit generates a first control signal when the displayed frames are not configured as a dynamic frame, and the detection unit generates a second control signal when the displayed frames are configured as a dynamic frame;

a clock generating unit for generating the clock signal, wherein the frequency of the clock signal is the first frequency in response to the first control signal, and the frequency of the clock signal is the second frequency in response to the second control signal; and a timing control unit for setting the screen refresh rate in response to the frequency of the clock signal.

12. The OLED display apparatus as claimed in claim 11, wherein the detection unit determines whether pixel data being greater than or equal to a second predetermined percentage in a plurality of neighbor frames being greater than or equal to a first predetermined percentage vary continuously, in which the neighbor frames are defined as a static frame and the detection unit generates the first control signal when the pixel data in the neighbor frames do not vary continuously, and the neighbor frames are defined as the dynamic frame when the pixel data in the neighbor frames vary continuously.

13. The OLED display apparatus as claimed in claim 12, wherein the first predetermined percentage is 50%.

14. The OLED display apparatus as claimed in claim 12, wherein the second predetermined percentage is 50%.

15. The OLED display apparatus as claimed in claim 12, wherein the neighbor frames and a black frame are displayed alternately when the drive circuit sets the screen refresh rate in response to the first frequency.

16. The OLED display apparatus as claimed in claim 12, wherein the second frequency is an original display frequency of the neighbor frames.

17. The OLED display apparatus as claimed in claim 11, wherein the detection unit detects a display mode of the OLED display array, the detection unit generates the second control signal when the display mode is a dynamic display mode, and the detection unit generates the first control signal when the display mode is not the dynamic display mode, the dynamic display mode means that pixel data being greater than or equal to a second predetermined percentage in a plurality of neighbor frames being greater than or equal to a first predetermined percentage vary continuously.

18. The OLED display apparatus as claimed in claim 17, wherein the detection unit determines the display mode in response to an order inputted by a user.

19. The OLED display apparatus as claimed in claim 10, wherein the first frequency is greater than or equal to twice the second frequency.

20. A method for adjusting a screen rate of, comprising the steps of:

determining whether a plurality of displayed frames of an organic light emitting diode display apparatus are configured as a dynamic frame;

generating a first control signal when the displayed frames are not configured as a dynamic frame;

generating a second control signal when the displayed frames are configured as a dynamic frame;

generating a clock signal, wherein a frequency of the clock signal is a first frequency in response to the first control signal, the frequency of the clock signal is a second frequency in response to the second control signal, and the first frequency is greater than the second frequency; and setting the screen rate in response to the frequency of the clock signal.

21. The method as claimed in claim 20, the determining step further comprising the step of:

determining whether pixel data being greater than or equal to a second predetermined percentage in a plurality of neighbor frames being greater than or equal to a first predetermined percentage vary continuously;

defining the plurality of neighbor frames as a static frame when the pixel data in the neighbor frames do not vary continuously; and defining the plurality of neighbor frames as the dynamic frame when the pixel data in the neighbor frames vary continuously.

22. The method as claimed in claim 21, further comprising the step of displaying the neighbor frames and a black frame alternately when the frequency of the clock signal is the first frequency.

23. The method as claimed in claim 21, wherein the second frequency is an original display frequency of the neighbor frames.

24. The method as claimed in claim 20, the determining step further comprising the step of:

detecting a display mode;

generating the second control signal when the display mode is a dynamic display mode; and generating the first control signal when the display mode is not the dynamic display mode;

wherein the dynamic display mode means that pixel data being greater than or equal to a second predetermined percentage in a plurality of neighbor frames being greater than or equal to a first predetermined percentage vary continuously.

25. The method as claimed in claim 20, wherein the first frequency is greater than or equal to twice the second frequency.

* * * * *